United States Patent [19]

Westerlund

[11] 4,069,128

[45] Jan. 17, 1978

[54] ELECTROLYTIC SYSTEM COMPRISING MEMBRANE MEMBER BETWEEN ELECTRODES

[75] Inventor: G. Oscar Westerlund, Vancouver, Canada

[73] Assignee: Gow Enterprises Limited, Vancouver, Canada

[21] Appl. No.: 693,752

[22] Filed: June 8, 1976

[30] Foreign Application Priority Data

May 3, 1976 Canada ..... 251641

[51] Int. Cl.[2] ..... C25B 1/16; C25B 1/26; C25B 9/00

[52] U.S. Cl. ..... 204/258; 204/98; 204/252; 204/253; 204/282

[58] Field of Search ..... 204/98, 128, 252, 253, 204/258, 275, 256, 282

[56] References Cited

U.S. PATENT DOCUMENTS

| | | | |
|---|---|---|---|
| 229,542 | 7/1880 | Martin | 204/252 X |
| 724,842 | 4/1903 | Garuti et al. | 204/252 |
| 1,157,830 | 10/1915 | Whitehead | 204/253 X |
| 1,315,982 | 9/1919 | Moulton | 204/252 X |
| 1,700,178 | 1/1929 | Porzel | 204/282 X |
| 2,349,662 | 5/1944 | Keating | 204/252 |
| 2,872,406 | 2/1959 | Buchanan | 204/282 X |
| 3,948,750 | 4/1976 | Figueras et al. | 204/282 X |

*Primary Examiner*—Arthur C. Prescott
*Attorney, Agent, or Firm*—Millen & White

[57] ABSTRACT

A novel anode unit is provided for a diaphragm cell. The anode unit comprises a generally rectangular parallelepiped framework including a pair of spaced-apart grid-like structurally rigid peripheral outer side walls; an ionically conductive gas impermeable membrane secured against the inner face of each such outer peripheral walls; an anode sealingly disposed between the membranes to provide a pair of fluid-tight anode compartments; means for feeding anolyte to the anode compartments; and means for withdrawing spent anolyte and entrained and/or occluded gaseous products of electrolysis therein from the anode unit. Novel diaphragm electrolytic cells including such anode units are also provided.

37 Claims, 11 Drawing Figures

ELECTROLYTIC SYSTEM COMPRISING MEMBRANE MEMBER BETWEEN ELECTRODES

BACKGROUND OF THE INVENTION i. Field of the Invention

This invention relates to an electrolysis system including an electrolytic cell of the diaphragm-type particularly suitable for the production of chlorine and caustic. It relates, more specifically, to an electrolysis system including an improved diaphargm-type electrolytic diaphragm-type and apparatus containing multiple such diaphragm-type unit cells and to a method of operating such system. The present invention also relates to an improved such diaphragm-type electrolysis apparatus and improved electrolysis process using such improved diaphragm-type cells.

ii. Description of the Prior Art

The benefits of the use of metal electrodes in the manufacture of chlorine-alkali, chlorate, perchlorates, etc. have been indicated in many publications: Canadian Pat. No. 771,140 issued Nov. 7, 1967 to S. I. Burghardt relates to the advantages of metal electrodes; Canadian Pat. No. 631,022 issued Nov. 14, 1961 to R. G. Cottam and M. G. Derlez relates to improvements in anodes of that type.

Diaphragm-type electrolytic cells have also advanced in performance with the availability of dimensionally stable anodes, e.g., metal anodes. In the chlor-alkali industry these anodes were proven successful commercially after 1966. However, electrolytic cell design has not changed too significantly even while imploying the new anodes.

It has recently been suggested that perfluorinated ion exchange membranes, especially that known by the Trade Mark of Nafion (Du Pont) be used as the diaphragm for chlorine and caustic production using such diaphragm-type electrolytic cells. It was suggested that if such diaphragm were successful in performance, the electrolytic cell employing this type of membrane would substantially eliminate several of the disadvantages of diaphragm cells, e.g., health hazard to personnel from ythe asbestos fibres heretofore used in the diaphragm. This would also obviate the requirement of salt crystallization and separation of catholyte which is not a necessity for the catholyte from the membrane cell. The membrane cell, however, offers challenges in design for efficient utilization of the properties inherent with membranes and the utilization of modules for ease of assembly and maintenance, as well as for optimum conditions.

For example, in chlorine/caustic production, the following are the reactions:

i. Anode reaction:

$$2Cl^- \rightarrow Cl_2 + 2e^-$$

Brine is fed into the anode compartment of the cell and the spent brine plus chlorine is released from the compartment and cell.

ii. Cathode reaction:

$$2H_2O + 2e^- \rightarrow 2OH^- + H_2$$

Water is fed into the cathode compartment of the cell and caustic plus hydrogen is released from the compartment and cell.

iii. Membrane:

The membrane provides an ionically conductive impermeable barrier substantially completely to prevent mixing of the gaseous products and electrolytes respectively. The membrane allows sodium ions to pass into the cathode compartment, but largely excludes both chloride and hydroxyl ions (caustic). The caustic thus formed in the cathode compartment is essentially salt free.

The diaphragm-type cells heretofore provided were of the single cell system-type which involves many concentrations and units for commerical production. This type is likely to be high in capital cost, difficult to control, high in maintenance cost and subject to production interruptions. If larger units are used, the amperage load would tend to be high, which increases power equipment cost and generally makes it difficult to design such cells for efficient and safe operations.

It has previously been found that the dimensions of the membrane, i.e., the width and length respectively, linearly expand up to 20% in the cell. This generally results in blockage of product flow and often results in cracking of the membrane. To minimize dimensional increase and also to strengthen the membrane, such membranes are generally available with a polytetrafluoroethylene fabric, e.g. that known by the Trade Mark of Teflon, on one side. The linear increase is less in this case, but still is significant (approximately 3%). The cell voltage tends to increase and in some cases the fabric results in a sealing problem.

It is known that the membrane must effectively divide the anode and cathode compartments without hydraulic leaks of electrolyte from one compartment to the compartment on the opposite side. Even a pinhole leak would, in most cases, be sufficient drastically to reduce the efficiency and would tend to jeopardize successful operation. Thus, a liquid-tight seal is of utmost importance.

It is also known that the membrane will fail with time as will other parts of the electrolyte system. The electrolytic system should, therefore, be of the type that may be easily disassembled and the parts thereof readily replaced.

The electrolyte flow rate should preferably be many times higher than material balance requirement in order to achieve highest efficiency. Minimum flow control is also desirable.

It is also desirable that the electrodes be spaced as closely as possible in order to minimize cell voltage, but they should not be spaced so closely that they block the flow of electrolyte and gaseous products.

It is also known that the current efficiency is drastically reduced at higher strength catholyte because of back migration of hydroxyl into the anode compartment.

SUMMARY OF THE INVENTION i. Aims of the Invention

It is therefore an object of this invention to provide an electrolytic system, including modules, to yield satisfactory results and be an advancement in technology of electrolytic system employing membrane members ro separate anode and cathode products respectively. It is another object of this invention to provide high electrolyte flow rate by means of cascade flow and/or recirculation by hydraulic or gas lift and also by means of an hydraulic brine system, thereby not only tending to eliminate the need for flow control, but also allowing for use for temperature control if desirable.

It is yet another object of this invention to provide optimum electrode spacing by means of a module design.

It is a further object of this invention to provide proper balance in product strength and current efficiency by means of cascade modules within an electrolytic system in order that the end product be relatively high in strength while sacrificing only a minimum of current efficiency.

ii. Statement of the Invention

This invention provides, broadly, an anode unit for a diaphragm cell, the unit comprising a generally rectangular parallelepiped framework including a pair of spaced-apart, grid-like, structurally rigid, peripheral outer side walls; an ionically conductive gas impermeable membrane secured against the inner face of each outer peripheral walls; an anode sealingly disposed between the membrane to provide a pair of liquid-tight anode compartments; means for feeding anolyte to the anode compartments; and means for withdrawing spent anolyte and entrained and/or occluded gaseous products of electrolysis therein from the anode compartments.

This invention also provides an electrolyzer cell box comprising: (A) a plurality of rows of banks of interleaved anode units and cathode, with each bank comprising alternating anode units and cathodes, each anode unit/cathode comprising a generally rectangular parallelepiped framework including a pair of spaced-apart grid-like structurally rigid peripheral outer side walls; an ionically conductive gas impermeable membrane secured against the inner face of each such outer peripheral walls; an anode disposed between the membranes to provide a pair of anode compartments, the anode extending beyond the anode unit to provide a cathode, the cathode being provided with spacing electrically non-conductive buttons thereon; means for feeding anolyte to the anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from the anode unit; and means associated with the inlet channel for separating and withdrawing entrained and/or occluded gaseous products of electrolysis from the anolyte before the anolyte is fed to the anode compartments; (B) an anode connecting means connected to the last anode of each row of anode units; (C) a cathode connecting means connected to the first cathode of each row of cathodes; (D) anolyte inlet means to the last anode unit of each row of anode units; (E) means for connecting the downstream anode unit to the immediately adjacent upstream anode unit in each row of anode units for cascading anolyte upstream and removing gaseous products of electrolysis; (F) spent anolyte outlet means from the first unit of each row of anode units; (G) catholyte inlet means to the cathode chambers; (H) spent catholyte outlet means; and (I) catholyte gas outlet means.

This invention, provides, still further, an electrolyzer cell box comprising a generally rectangular parallelepiped box containing: (A) a plurality of rows of banks of interleaved anode units and cathodes, with each bank comprising alternating anode units and cathodes, each such anode unit/cathode comprising a generally rectangular parallelepiped framework including a pair of spaced-apart grid-like structurally rigid peripheral outer side walls; an ionically conductive gas impermeable membrane secured against the inner face of each such outer peripheral walls; an anode disposed between the membranes to provide a pair of anode compartments, the anode extending beyond the anode unit to provide a cathode, the cathode being provided with spacing electriocally non-conductive buttons thereon; means for feeding anolyte to the anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from the anode unit; and means associated with the inlet channel for separating and withdrawing entrained and/or occluded gasecus products of electrolysis from the anolyte before the anolyte is fed to the anode compartments; (B0) an anode connecting means connected to the last anode of each row of anode units; (C) a cathode connecting means connected to the first cathode of each row of cathodes; (D) anolyte inlet means to the last anode unit of each row of anode units; (E) means for connecting the downstream anode unit to the immediately adjacent upstream anode unit in each row of anode units for cascading anolyte upstream and removing gaseous products of electrolysis; (F) spent anolyte outlet means from the first unit of each row of anode units; (G) catholyte inlet means to the cathode chambers; (H) spent catholyte outlet means; (I) catholytic gas outlet means; (J) a downwardly sloping front wall; and (K) wedge means disposed between an adjacent anode unit of each bank and the front wall, thereby to hold the anode units in place.

This invention, also provides an electrolyzer cell box comprising a generally rectangular parallelepiped box containing: (A) a plurality of rows of banks of interleaved anode units and cathodes, with each bank comprising alternating anode units and cathodes, each such anode unit/cathode comprising a generally rectangular parallelepiped framework including a pair of spaced-apart grid-like structurally rigid peripheral outer side walls; an ionically conductive gas impermeable membrane secured against the inner face of each such outer peripheral walls; an anode disposed between the membranes to provide a pair of anode compartments, the anode extending beyond the anode unit to provide a cathode, the cathode being provided with spacing electrically non-conductive buttons thereon; means for feeding anolyte to the anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from the anode unit; and means associated with the inlet channel for separating and withdrawing entrained and/or occluded gaseous products of electrolysis from the anolyte before the anolyte is fed to the anode compartments; (B) an anode connecting means connected to the last anode of each row of anode units; (C) a cathode connecting means connected to the first cathode of each row of cathodes; (d) anolyte inlet means to the last anode unit of each row of anode units; (E) means for connecting the downstream anode unit to the immediately adjacent upstream anode unit in each row of anode units for cascading anolyte upstream and removing gaseous products of electrolysis; (F) spent anolyte outlet means from the first unit of each row of anode units; (G) catholyte inlet means to the cathode chambers; (H) spent catholyte outlet means; (I) catholyte gas outlet means; (J) a downwardly sloping front wall; (K) wedge means disposed between an adjacent anode unit of each bank and the front wall, thereby to hold the anode units in place; (L) the anolyte inlet means being disposed near the top of the cell box; (M) a plurality of riser pipes extending upwardly from each anode unit, the riser pipes in each bank leading to a common connecting header, each common connecting header leading to an associated common outlet riser which in turn leads to a main anolyte gas outlet header pipe; (N) catholyte inlet means to the top of the seled cover; (O) spent catholyte outlet overflow weir means from the sealed cover disposed an optimum distance from the catholyte inlet means to provide controlled catholyte level and catholyte gas space; and (F) circulation means provided by internal pumping action due to the construction and arrangement of the cathodes and anode units and the rising gaseous products of the electrolysis of the catholyte, with the outlet means from the electrolyzer providing at least a partial separation of entrained gaseous products of electrolysis of the catholyte from the spent catholyte.

iii. Other Features of the Invention

By one variant of this invention, the unit includes a channel member along one edge thereof and a lower trough for feeding and distributing anolyte to the anode compartments, especially where the lower trough comprises a lower conduit provided with a plurality of upper spaced-apart apertures for feeding anolyte to the anode compartments.

By another variant, the unit includes an upper header for receiving spent anolyte and entrained and/or occluded gaseous products of electrolysis and enabling the withdrawal thereof from the unit, especially where the upper header comprises an upper conduit provided with a plurality of lower spaced-apart apertures for withdrawing anolyte and entrained and/or occluded products of electrolysis from the anode compartments.

By still another variant, the unit includes means associated with the inlet channel for separating and withdrawing entrained and/or occluded gaseous products of electrolysis from the anolyte before the anolyte is fed to the anode compartments, especially where the inlet channel comprises a conduit provided with an upper "I" member, disposed on its side, the horizontal portion providing a liquor/gas inlet, the lower vertical portion providing a liquor inflow conduit, the upper vertical portion providing a gas outflow conduit.

By yet another variant, the unit includes means for recirculating anolyte within the anode compartments of the anode unit.

By a variation thereof, such means comprises a vertical channel member provided with vertical flanges for holding the anode, the flanges being provided with upper and lower recirculation perforations, especially where sealing gaskets are provided between the vertical flanges and the anode.

By another variant, the anode extends beyond the anode unit to provide a cathode.

By a variation of such variant, the cathode is provided with spacing electrically non-conductive buttons thereon.

By still another variant, the anode unit is provided as a plurality of components bolted together by peripherally disposed bolts, especially where the bolts pass through mating apertures in opposed peripheral portions of the framework, the apertures being provided with sealing sleeves or gaskets.

By yet another variant, the anode is titanium, or titanium having a coating thereon of ruthenium oxide, platinum or platinum/iridium thereon.

By a further variant, the cathode is titanium, low carbon mild steel, or nickel alloys.

By a still further variant, the membrane is a thin unsupported film of plastic material, e.g. a polytetrafluoroethylene fabric reinforced thin plastic material, or a perfluorinated ion exchange membrane.

By yet another variant, the grid-like outer walls comprise a structurally rigid membrane supporting sheet provided with openings or perforations.

By a variation of such variant, the framework is provided with three inwardly facing channels, within which the plurality of components are disposed, the anode being disposed in the mid-channel, with sealing members disposed between the structurally rigid membrane, supporting sheet and outer flanges defining a limit of the outer channels.

By a still further variant, the grid-like outer walls comprise expanded metal, e.g. titanium, sheeting.

By still another variant, the grid-like outer walls comprise porous sintered powder sheeting, e.g. are formed of titanium or plastic; the sheet to have at least 45% open area.

By yet another variant, the grid-like outer walls and membranes are in the form of a single unit comprising porous sintered powdered titanium sheeting of 70% or more porosity within whose pores are disposed powdered perfluorinated ion exchange material.

By yet another variant, there is a sealing gasket provided between the membrane and spacing members disposed adjacent the anode.

By yet another variant of this invention, the cover slopes upwardly from the catholyte inlet to the catholyte gas outlet, especially wherein the catholyte gas outlet leads directly from the cover, from a point adjacent the greater cross-sectional area end thereof.

By a second variant of this invention, the cover includes a tray comprising an external extension of the cover, through which the common outlet risers extend.

By yet another variant, the wedge extends for substantially the entire height of the cell box.

By still another variant, the wedge cooperates only with the top portion of the cell box.

By a still further variant, the liquor outflow means from each anode unit includes a degasifier zone and an outflow riser pipe leading from the degasifier zone to the connecting header.

BRIEF DESCRIPTION OF THE DRAWINGS

In the accompanying drawings.

DESCRIPTION OF PREFERRED EMBODIMENTS i. Description of FIGS. 1 and 2

Figure 1:
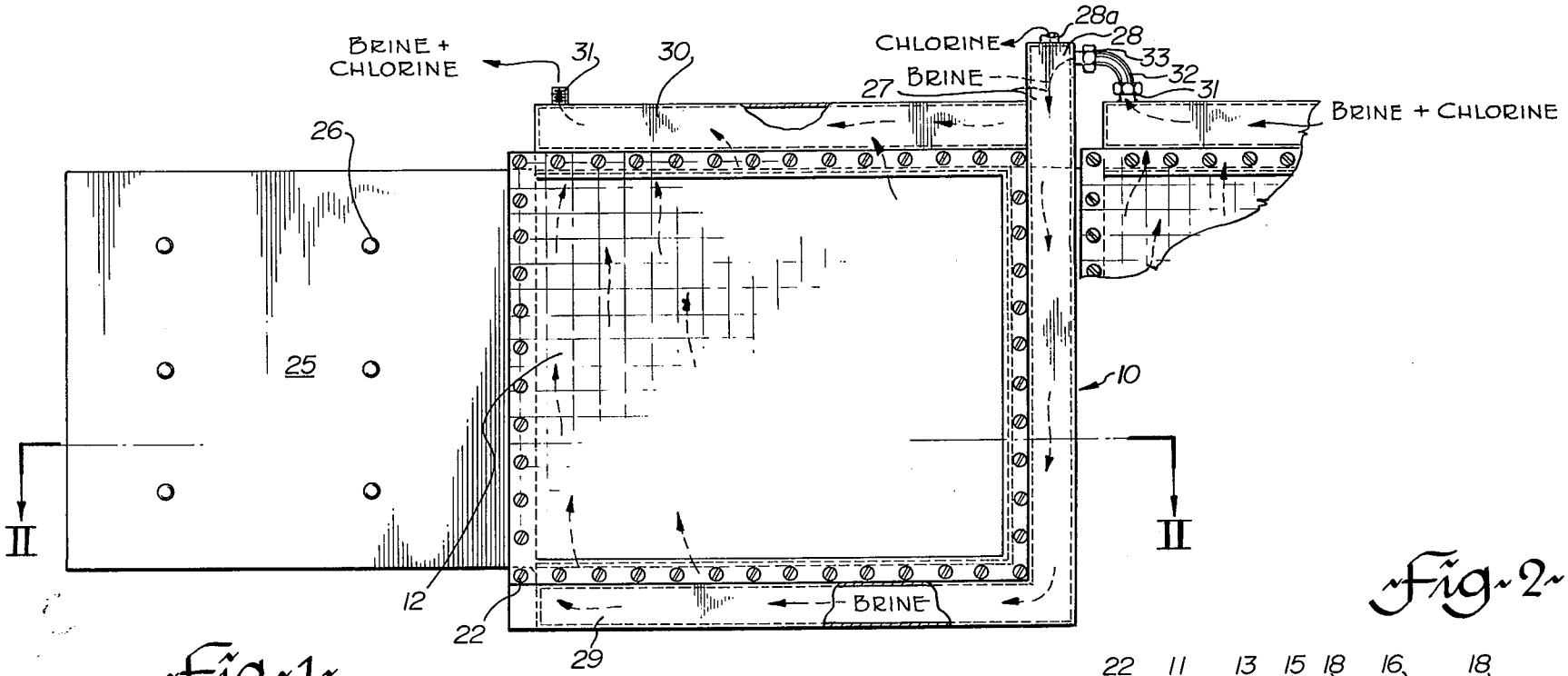
FIG. 1 is a side elevational view of an anode/membrane/cathode unit of one aspect of this invention.
Figure 2:
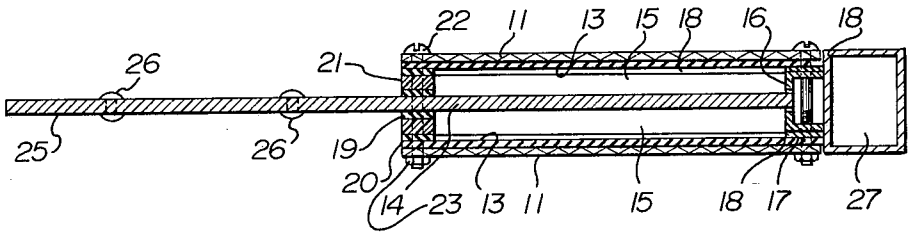
FIG. 2 is a section along the line II—II of FIG. 1.

As seen in FIGS. 1 and 2, the anode/membrane/cathode unit 10 of one aspect of this invention is a hollow rectangular parallelepiped including two outer side walls comprising generally rectangular structural supports 11 which are generally of the same rectangular shape as the unit 10. It is essential that the structural supports 11 be porous. The structural sheeting 11 employed herein according to variants of the invention has openings, or perforations, 12 or is provided as expanded sheeting or porous fused powder sheeting. Plastic sheeting is possible, but titanium is preferred because of its structural advantages and best performance. By this invention, it is possible to take advantage of the structural strength and support characteristics and perforations. Structurally, the sheet substantially prevents the membrane from "flexing" against the cathode.

Disposed against each of the inside faces of each of the structural sheetings 11 is an internal membrane 13. The membrane provides an ionically conductive impermeable barrier, as described hereinabove. One particularly effective material for the membrane 13 is Nafion film, 1 to 20 mils thick, available from Du Pont.

Sealingly held centrally within the hollow rectangular parallelepiped is an anode 14 providing a pair of anode compartments 15. One end of the anode 14 is set within the spaced-apart flanges 16 of a vertically positioned anolyte recirculation channel member 17. While not shown, the flanges 16 at the top and bottom of the channel member 17 are each provided with perforations to enable anolyte flow. The channel member 17 is held against, but maintained in liquid-tight relationship to, membrane 13, by means of gasket 18.

The other end of the anode 14 projects beyond the anolyte chambers 15 and is held in liquid-tight contact by means of gaskets 19 in contact with the anode 14, and 20 in contact with the membrane 13, as well as suitable spacers 21. The anode module section is held together by a plurality of peripherally spaced bolt 22 and nut 23 units.

The portion of the anode 14 which protrudes from the anode compartments 15 of the module 10 is the cathode 25. The cathode 25 preferably is titanium but may also be other cathodic material, e.g. steel; in such case, there should be an overlap at the bolt joint. The cathodes 25 are equipped with plastic buttons or rivets 26. Suitable materials include Teflon, polyvinyl chloride (PVC), etc. The purpose of these buttons is by means of the electrically resistant buttons to space the cathode sheet from an adjacent module to ensure that they do no short circuit. Furthermore, without adjustment and alignment by loosely fitting against each other, proper and desirable spacing for the catholyte is established by these means.

The length of the cathode 25 is shorter than the length of the anode module section. This provides a channel 91 (see FIGS. 6A and 6B) for recirculation of catholyte, if desired, by hydrogen gas lift driving force.

Provided on the upstream side of the anode unit 10 is a downcomer channel support anolyte inlet 27. Anolyte inlet 27 has a height greater than the height of the anode unit 10, and so provides a space 28 for gas/liquid separation. The gas is drawn off via anolyte gas outlet 28*a*, while the liquor is led to a horizontal distributor base trough 29 leading freely to the anode compartments 15. The anolyte rises by gas lift to an upper header 30 which is provided with a common liquor and gas outlet pipe 31. This may be connected to an elbow 32 to an inlet 33 to anolyte inlet 27.

In one embodiment of the invention, the porous structural support was a perforated 0.3 mm thick titanium sheet, 2 mm holes about 45% open area. This gave a differential voltage increase of 0.1 volt at 1500 amps per square meter. A plastic sheet would have to be thicker (up to 1 mm) and voltage increase becomes significant (0.5 and higher).

In a further embodiment of this invention in producing the membrane, Nafion powder, 0.2 to 0.5 mm in size was ground under liquid nitrogen freezing conditions. Porous powder titanium sheeting (70% porosity, 10–30 micron pore size) was plugged with this powder and successfully operated as a dimensionally stable membrane, i.e., in this case the module would not require any structural member.

2 mm thick sheeting is about the maximum to achieve reasonable voltage readings; 1 mm is preferred and 0.2 mm would be the extreme minimum due to the low mechanical strength. For thicker sheets it is important electrically to short circuit this membrane with the cathode/anode, otherwise the cell voltage could significantly increase (probably gas build-up inside the plate if partially working as a cathode).

The membrane may be of different types:

a. a film about 0.03 to 0.3 mm thick; this film is the "membrane" without additives. This film is lower in voltage but has less mechanical strength and readily swells with very large width and length linear dimensional increase at the normal cell conditions up to 20%. Thus, when used in a dimensional stable frame the film, after a few days, appears as a corrugated mesh (i.e., expansion occurs in both directions) which could seriously upset good flow conditions as well as seal itself against the electrodes in some areas which also contributes to increased voltage. This uncontrolled dimensional swelling also lowers the life cycle of the film.

b. a film as above but reinforced with Teflon fabric. This does mechanically improve the film as well as lower its linear dimensional increase to less than 5%; however, even this is large. Furthermore, the cell voltage is significantly increased by the resistance of Telfon fabric (up to 1 volt at 1600 amps per square meter).

By another embodiment of this invention, the above-noted membranes may be used, i.e. by the use of a structural member, in association with the membrane. In all cases, some member (frame or flange) is required to cause an effective seal of the membrane against the gasket.

With a pressure higher inside the module than outside, the linear expansion is directed into the perforated holes. Thus, voltage actually is reduced by the enlarged surface area. The sheeting will have the appearance of multi-indentations from the anode side after being used in the cell. The thin structural member extends the life of the membrane by the multi-unit swellings which is "gentle" on the film. The perforated member is, by the small thickness, able to flex just sufficiently not unduly to wear the membrane. Using a powder, either porous or perforated, the sheet gives a slight improvement at about double the sheet thickness compared to the solid perforated sheet, but the cost is significantly higher and this sheet has a tendency of cracking and breaking up. A thicker sheet which structurally is satisfactory shows poorer voltage performance (up to 0.5 volt differential voltage). A 2 mm thick, 70% porosity, 10 micron pore size, machined to make 4 mm diameter indentations to about 1.8 mm deep (i.e., not perforated) did not improve on the result of the thin perforated solid sheet.

An inherent property of titanium is that is oxidizes as the anode and the sheet for practical purposes becomes inactive under normal cell conditions. Already after 20 minutes operating current flow to and from the structural member is less than 0.6% and after 24 hours it is less than 0.2%.

The anode module section comprises structural members having a dual purpose, namely: (i) to channel the anolyte, and (ii) to support and frame the membrane. The active anolyte flows between the anode and the membrane which is spaced on each side of the anode. The spacing is controlled by gaskets of suitable material, e.g. silastic rubber and spacers of titanium, hard rubber, Teflon or other chemically resistant material. The spacing for the anolyte flow is not more than 15 mm (voltage increase with spacing); on the other hand, not less than 1 mm since restriction of flow also causes high voltage. The channels have a dual purpose, namely: (i) to provide firm flanges for sealing the anode compartment which is essential in order to achieve acceptable products and current efficiency; and (ii) anolyte is recirculated within the module compartment, if desirable, by employing a channel to allow anolyte to flow back from the top to the bottom by means of up-lift of gas produced onto the anode. This is important only if anolyte velocity would be low (below 15 meter per hour). The flanges must be perforated for the top and the bottom flanges in order to allow the anolyte to enter the compartment and leave, respectively, into the top channel to discharge through the outlet nozzle and for recirculation via the channel if desirable.

The channel member 17 may be titanium (which structurally is more stable) or a plastic extrusion, e.g. polyvinyl dichloride (PVDC) or polypropylene. It should be noted that although the rectangular profile is the most compact module design, a circular tube may also be used. In case titanium is used, care must be taken electrically not to short circuit the cells. This is avoided by allowing the gasket 18 to extend and fold over the bolt head 33 and nut 23 respectively. The bolts preferably are of plastic material, e.g. polypropylene, which will minimize buttons on the cathodes. However, titanium machine bolts and countersunk screws, respectively, may be used without problems.

ii. Description of FIGS. 3 and 4

Figure 3:
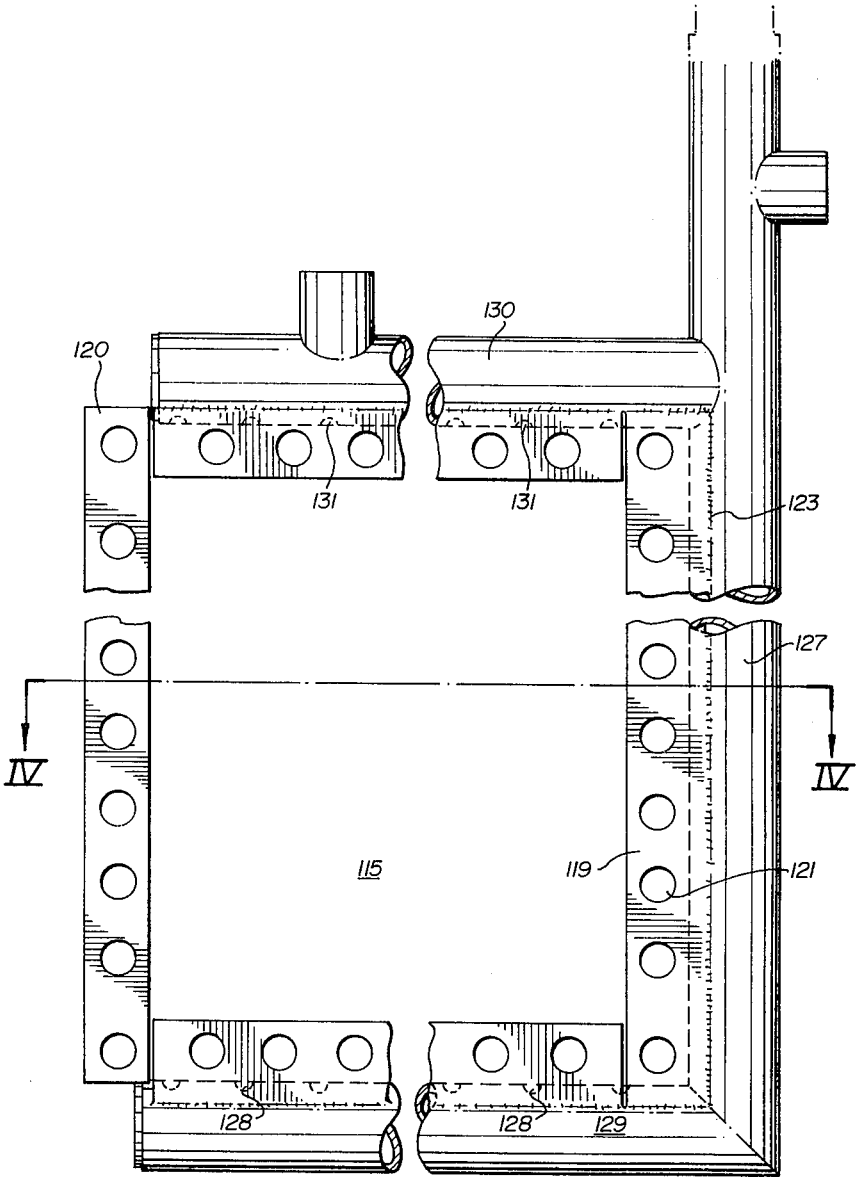
FIG. 3 is a side elevational view of the module frame used in a variant of this invention.
Figure 4:
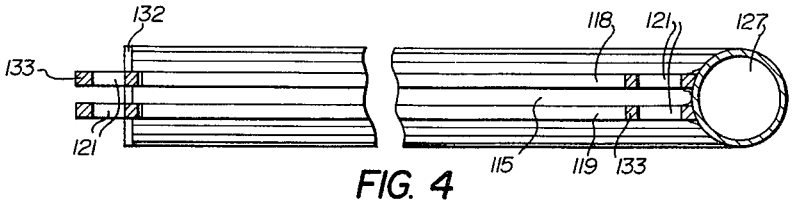
FIG. 4 is a section along the line IV—IV of FIG. 3.

As seen in FIGS. 3 and 4, the module frame 120 includes a pair of spaced-apart peripheral bars 118, 119 extending completely around to provide the main framework. A plurality of equally spaced-apart apertures 121 are provided for the bolts 122 which hold the components together. Along the upstream vertical side 123 is an inlet conduit 127, which in this variant, is a tubular conduit. Tubular conduit 127 leads directly to a bottom feeder 129, which, in this variant, is a tubular conduit. Tubular conduit 129 is provided with a plurality of spaced-apart apertures 128 for the feeding of anolyte liquor to the anolyte chambers 115. A header 130 is provided at the top, the header 130 being fed by a plurality of spaced-apart apertures 131 for the outflow of anolyte and cell gas from the anolyte chambers 115. The downstream vertical side of the frame is provided with a transverse spacer bar 132.

As seen in FIG. 3, the apertures 121 are each provided with gaskets 133 to prevent liquor leakage. The gaskets are preferably formed of silastic. By these means, leakage through the bolt holes is greatly minimized.

iii. Description of FIG. 5

Figure 5:
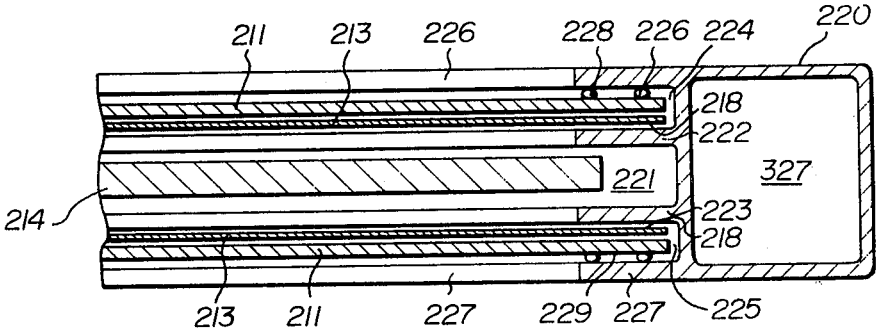
FIG. 5 is a sectional view, similar to FIG. 3, showing another variant of this invention.

As seen in FIG. 5, the peripheral framework is provided by flanged members 220 provided with central U-channel 221 defined by flanges 222, 223, and external channels 224, 225, defined by flanges 226 and 222, and by flanges 223 and 227, respectively. Each of flanges 222, 223, 226 and 227 extends completely around the internal periphery of the frame members 220. The downcomer channel support anolyte inlet 327 is disposed on the outside of channel framework 220. The membrane supports 211 are disposed in channels 224 and 225 and are sealed against the inside faces of flanges 226 and 227 by O-ring seals 228, 229 formed, e.g. of "Vitron" rubber or "Teflon". The usual gaskets 218 are provided in channels 224, 225 between the membranes 213 and the flanges 222, 223. The membranes 213 are sealed against the flanges, or against the gaskets if the surface of the flanges is not sufficiently flat, by compression of O-rings. The O-rings are squeezed into position and are held by the upper flanges. This provides a substantially leak-free construction.

Thus, as described above, special care must be taken to provide a seal, e.g. of silastic rubber, between the bolts and the holes, to minimize and even substantially to avoid leakage of anolyte. Bolting can be eliminated by using the design of another embodiment of this invention by pressing the membrane against a flange using a wedge or an O-ring seal.

iv. Description of FIGS. 6 and 7

Figure 7:
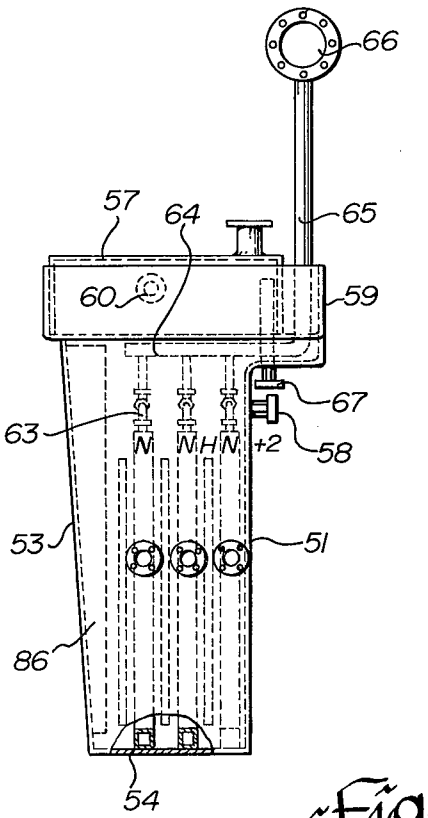
FIG. 7 is an end elevational view of the electrolysis system of FIG. 6, shown partly in phantom.
Figure 6:
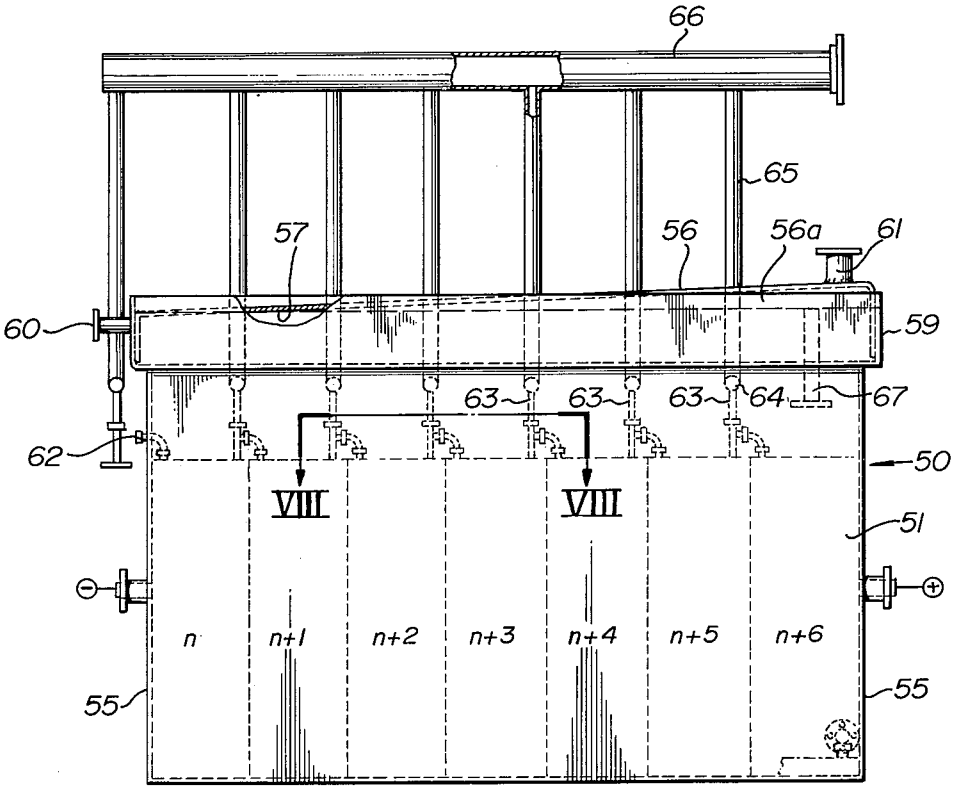
FIG. 6 is a side elevational view, partly shown in phantom, of an electrolysis system of another aspect of this invention provided with the anode/membrane/-cathode unit of an aspect of this invention.

Turning now to FIGS. 6 and 7, the container 50 for the electrolysis system is a generally rectangular tank 51 including a back wall 52, a downwardly inwardly sloping front wall 53, a bottom 54, a pair of end closures 55 and a top cover 56. The top cover slopes upwardly 57 toward the anolyte inlet end where anolyte is fed to the electrolysis unit via anolyte inlet 58. A tray extension 59 surrounding the cover 56 is provided associated with the cover 56, for a purpose to be explained hereinafter. The catholyte is fed in through an upper catholyte inlet tube 60 and spent catholyte is withdrawn via weir overflow 67. The catholyte gases accumulate in the upper region **56*a* of the cell below the cover 56 and are led out via catholyte gas outlet 61. The anolyte enters through anolyte inlet tube 58 and is withdrawn via spent anolyte tube 62. The anolyte gases are accumulated in outlet lines 63 and are fed to gas header 64 from whence they are drawn off through outflow pipes 65 to header pipe 66**.

The tray 59 allows anolyte gas outlet pipes 65 to outlet on the outside of the cover 56 (which is sealed) and through tray 59, thereby maintaining catholyte liquor level below the cover 56, and a gas pressure less than the available liquor seal head which is established by outlet (catholyte finished product) weir pipe 67. All anolyte gas pipes 65 are discharged into the header pipe 66. The cover 56 is preferably sloped at 57 to lead catholyte gases to the outlet mozzle 61, thus minimizing gas volume at the top 56*a* of the electrolyzer 50. The liquor level should not reach the cover 56; an actual gas zone 56*a* is required in order not to pump liquor by gas lift to the adjacent cell which would cause internal curculation and mixing, which is not desired for maximum efficiency result. The gas zone requirement is least at the first cell; the last cells have the accumulated gases from all cells (catholyte gases). The gas outlet may be at the centre of the length sloping both sides which would require less gas zone, but it is generally more convenient to have the outlet at one end.

The liquor feed inlet 60 for the catholyte is located at the opposite end of the weir pipe outlet 67 in order gradually to increase the strength of the catholyte product. The strength increases linearly when plotted against the cell member. The differential increase in concentration depends upon current load and flow rate.

v. Description of FIGS. 9A and 9B

The container is required to be electrically resistant to establish multi-cell assembly; for chlor/alkali system, a polyester resin tank, glass fibre reinforced, is satisfactory. Since the catholyte only is in contact with the container, the corrosion attack is not severe. This design is preferred also since it minimizes health risks by gas leaks should the cover lift or the seal fail. Actually it would not be practical to employ the liquor seal by electrolyte if it was anolyte from a chlorine cell since some chlorine would be vaporizing from seal liquor. It is, however, possible to reverse conditions using catholyte inside the module member. However, it is advantageous to have catholyte in the main container.

Figure 9A:
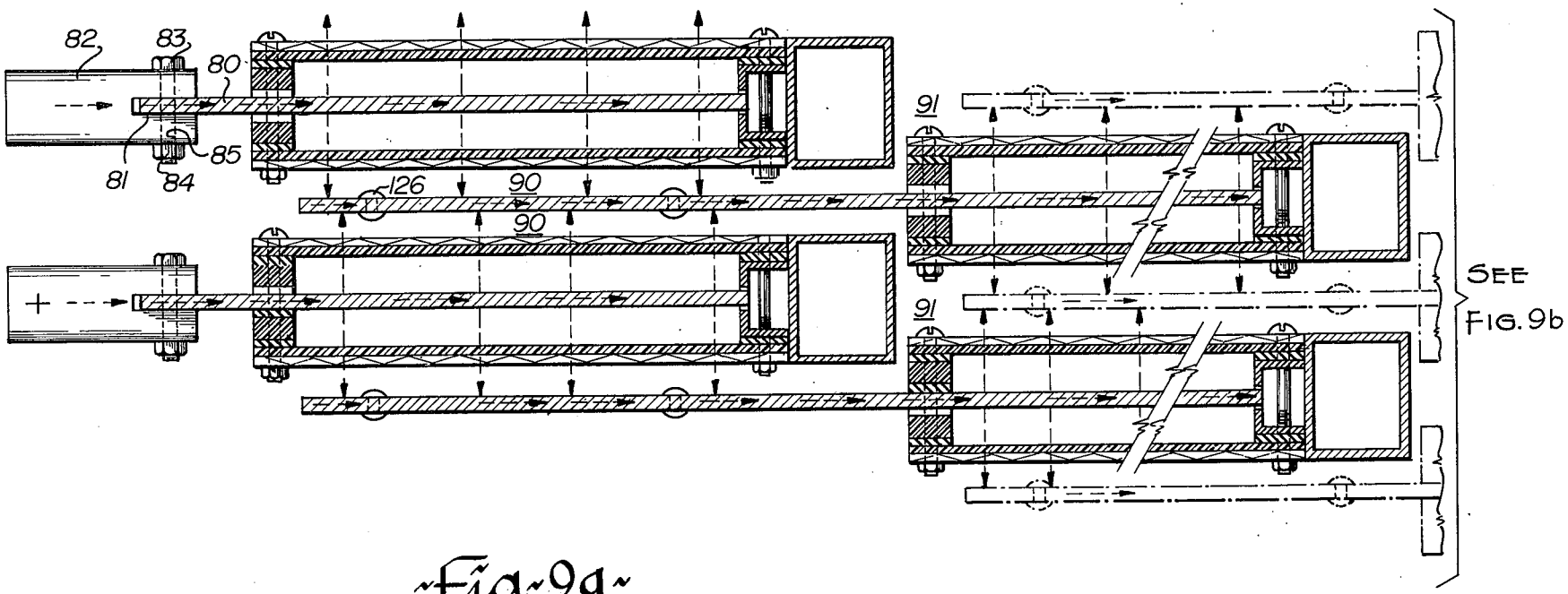
FIGS. 9A and 9B are cross-sectional views, partially in broken lines, of the assembled units of one aspect of this invention, in an electrolysis system of another aspect of this invention.
Figure 9B:
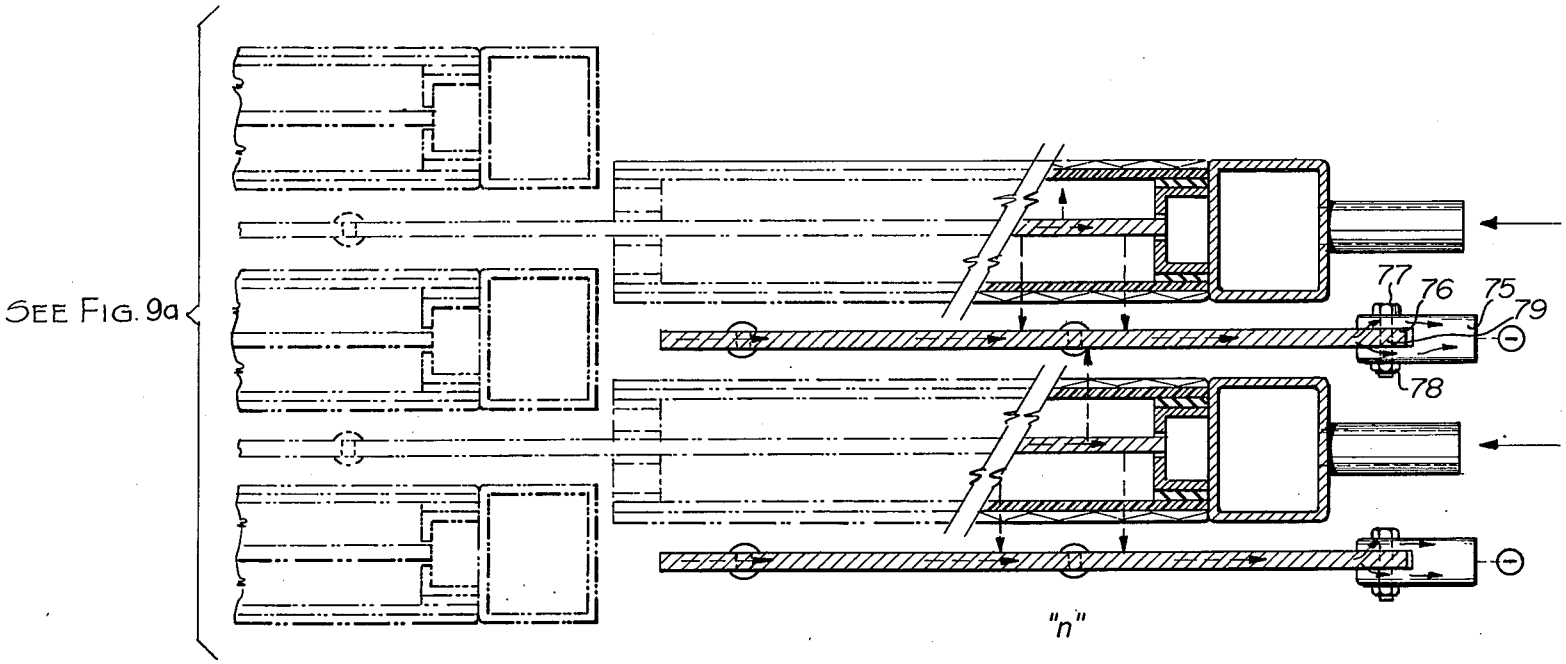

Disposed within the cell container 50 are a plurality of rows $n$, $n + 1$, $n + 2$, etc. and columns N, N + 1, N + 2, etc. of interleaved anode units 10 and cathodes 25. Thus, there are a number of rows, $n$, $n + 1$, $n + 2$, $n + 3$, $n + 4$, etc., and in each row there are a plurality of interleaved anode units 10 and cathodes 25, i.e. N, N + 1, N + 2, etc. As seen in FIGS. 9A and 9B, the cathode 25 from unit $2n$ is disposed between anode units $n + 1$ and $2(n + 2)$. The cathodes 25 in the first row n are each connected to a cathode connector 75 by means of entry into a slot 76 and being held in place by bolt 77 and nut 78 unit passing through registering appertures 79. Similarly, each anode unit 10 at the end is provided with an anode extension 80 disposed in a slot 81 in an anode connector 82 and is held therein with bolt 83 and nut 84 unit passing through registering apertures 85.

The plastic buttons 26 on cathodes 25 provide a means of spacing the cathodes from the anode units 10, thereby providing cathode chambers 90 between anode unit 10/cathode 25 couples in the same column, and catholyte channel 91 between cathode 25/anode unit 10 of adjacent columns.

vi. Description of FIG. 8

Figure 8:
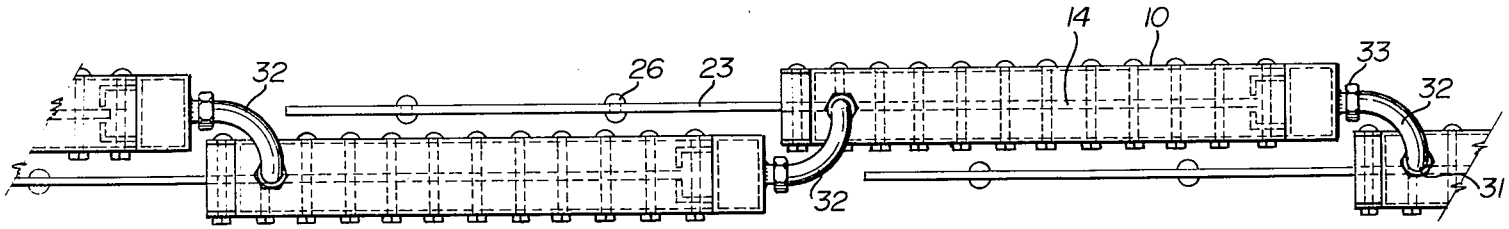
FIG. 8 is a section along the line VIII—VIII of FIG. 6.

The anolyte interconnections are as shown in FIG. 8 by means of anolyte gas and liquor outlet 31 of an anode unit 10 of one column, i.e. 2(2 + 4) to the inlet downcomer channel 27 of an anode unit 10 of an adjacent, upstream column, i.e., $n + 3$, and the outlet pipe 31 of that anode unit 10, i.e. $n + 3$, feeds the inlet downcomer channel 27 of an adjacent, upstream column, i.e. 2(n + 2).

The forward anode unit 10 of each column is held in place within the cell container 50 by means of cooperation between its peripheral framework and a wedge 86 contacting the sloping front wall 53. This takes up any variations in width of the anode unit 10 without making the cell tank 50 of different width for each column of anode unit 10/cathode 25 couple.

vii. Operation of Preferred Embodiments

The number of cells depends on the supply voltage. The module member is set upright onto the bottom of the unit container. A second module is connected longitudinally via a connector. The third module is connected via a connector to the second, etc., until all the cells are assembled and the last module member connected to the outlet connector.

For an amperage load of about 20,000 amps approximately 50 modules would be employed in each cell. To make installation easy and to secure spacing between modules, a wedge member, e.g., polycarbonate member, is found to be very desirable.

Current connectors are at each end of the container. Current flow through the unit is shown as in the prior art. Current leakage between cells is defined by ohms (low) with voltage potential equal to the average cell voltage and cross-sectional area of the electrolyte communicating/channelling between cells. This channelling is clearly defined for anolyte by the module connectors and the channels, and since the current path would normally be long, the current leakage is insignificant. To minimize the current leakage for catholyte (mainly in the channel above the module members), cell divider sheets may be employed at the top (not shown: vertical sheets along the imaginary line between the anode and the cathode). For most units the current leakage would be less than 1% without employing divider sheets (depending upon current load; higher load gives less current leakage percentagewise).

With anolyte, the gas produce on the anode (i.e. chlorine) will be discharged as well as dispersed via a connector to an inlet. Gas leaving through the discharge with the anolyte flows downwardly by hydraulic effect (brine feed head and static head in the pipe risers) through a channel through bottom opening into another channel and further into the anode compartment for a new cycle to the next module.

The anolyte flow may be described as follows: The fresh brine enters via inlet pipe 58 to the downcomer channel 27. It then flows downwardly to the horizontal distributor trough 29 where it leads by unencumbered slots directly to the anode chambers 15 within the anode unit. The brine flows upwardly in the anode chambers and is subjected to electrolysis to provide brine plus entrained and/or occluded chlorine gas, and this mixture is accumulated in the anode unit header 30. The liquor/gas mixture flows to the adjacent anode unit, i.e.

via outlets 31, 32, 33 to the downcomer channel 27. Since the downcomer channel 27 includes a portion 28 at a higher level, a gas/liquid interface is formed. The anolyte may also be recirculated through perforations in the flanges 16 of the channel 18. The chlorine is drawn off via line 28*a*, while the brine is fed downwardly to be further electrolyzed in the next upstream anode unit 10.

The catholyte flow may be described as follows. It enters through the upper catholyte inlet pipe 60 and passes downwardly through the cathode chambers 90 and channels where it is electrolyzed. The catholyte then rises by gas lift, and is withdrawn as caustic via weir overflow 67. The catholyte gas, i.e. hydrogen, passes through the cover header 56*a* and is withdrawn via outlet pipe 61.

The current flow may be described as follows. Current in the anode 14 flows longitudinally along the anode 14 and transversely across the anolyte in chamber 15, through the membrane 13, across the catholyte in chamber 90 and then longitudinally along the cathode 25 until it once again becomes a flow along the length of the anode 14. The cathode connectors 75 draw off this anode flow.

The system of an aspect of this invention provides the means which could achieve high efficiency and favourable manufacturing factors. It also offers the option of a choice of conditions and material selections. These options likely affect result, but the flexibility is desirable to make maximum use of the know-how and availability of material. In the case of a chlorine/alkali cell, e.g.:

i. The anode may be titanium, surface coated with ruthenium oxide, platinum, or platinum/iridium, respectively, and the voltage performance would normally be slightly different, but depending on application of coating, could differ in result as much as 20%.

ii. the cathode may be low carbon mild steel, surface treated titanium, nickel, or alloys. The choice of cathode could affect result drastically (up to 20% on voltage). Titanium is preferred, which has been surface treated to give an overvoltage potential equal or better than mild steel.

iii. The membrane thickness and polymer equivlent weight are factors on cell voltage; less thickness and equivalent weight polymer result in lower cell voltage, but also lower current efficiency and product purity.

iv. Flow rate of liquor through the system, current density, operating temperature, are other factors affecting result, i.e., efficiency of power consumption per unit production and product purity.

viii. Description of FIG. 10

Figure 10:
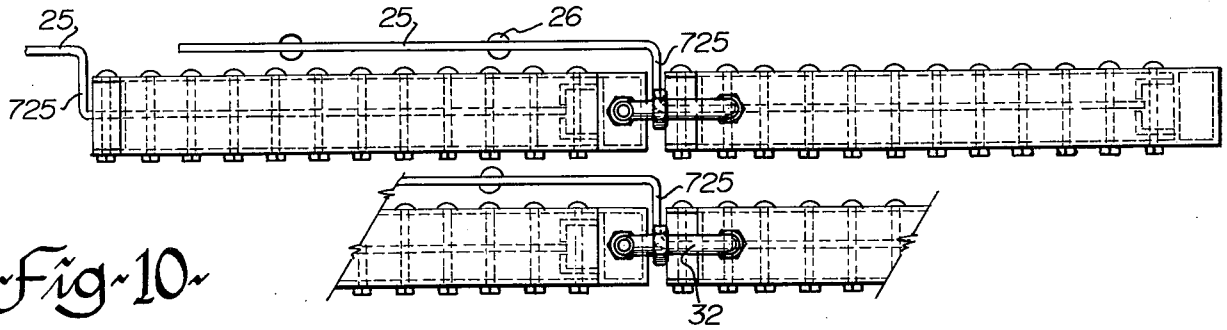
FIG. 10 is a section similar to that of FIG. 8, but of a different embodiment.

The embodiment of FIG. 10 is similar to that of FIG. 8 except that the cathode 25 is provided with an elbow portion 725. In this way, the connecting tubes 32 need not be laterally offset to connect anode units in different rows as well as differnet colums. It is then possible to provide interleaved, but not offset, anode/cathode assemblies.

SUMMARY

In conclusion, the improvment provided herein provides for flexibility and high efficiency under set conditions.

From the foregoing description, one skilled in the are can easily ascertain the essential characteristics of this invention, and without departing from the spirit and scope thereof, can make various changes and mofifications of the invention to adapt it to various usages and conditions. Consequently, such changes and modifications are properly, equitably, and "intended" to be, within the full range of equivalence of the following claims.

I claim:

1. An anode unit for a diaphragm cell comprising: a generally rectangular parallelepiped framework including a pair of spaced-apart grid-like structurally rigid peripheral outer side walls; an ionically conductive gas impermeable membrane secured against the inner face of each said outer peripheral walls; an anode sealingly disposed between said membranes to provide a pair of fluid-tight anode compartments; means for feeding anolyte to said anode compartments; and means for withdrawing spent anolyte and entrained and/or occluded gaseous products of electrolysis therein from said anode unit.

2. The anode unit of claim 1 including a vertical channel member along a leading edge thereof and a lower base trough for feeding and distributing anolyte to the anode compartments.

3. The anode unit of claim 2 wherein the lower base trough comprises a lower conduit provided with a plurality of upper spaced-apart apertures for feeding anolyte to the anode compartments.

4. The anode unit of claim 1 including an upper header receiving spent anolyte and entrained and/or occluded products of electrolysis and enabling the withdrawal thereof from the anode unit.

5. The anode unit of claim 4 wherein the upper header comprises an upper conduit provided with a plurality of lower spaced-apart apertures for withdrawing anolyte and entrained and/or occluded gaseous products of electrolysis from the anode compartments.

6. The anode unit of claim 1 including means associated with the inlet channel for separating and withdrawing entrained and/or occluded gaseous products of electrolysis from the anolyte before the anolyte is fed to the anode compartments.

7. The anode unit of claim 6 wherein the inlet channel comprises a conduit provided with an upper "T" member, disposed on its side, the horizontal portion providing a liquor/gas inlet, the lower vertical portion providing a liquor inflow conduit, the upper vertical portion providing a gas outflow conduit.

8. The anode unit of claim 1 including a vertical channel member for recirculating anolyte within the anode compartments of the anode unit.

9. The anode unit of claim 8 wherein said vertical channel is provided with vertical flanges for holding said anode, said flanges also being provided with upper and lower recirculation perforations.

10. The anode unit of claim 9 wherein said sealing gaskets are provided between the vertical flanges and the anode.

11. The anode unit of claim 1 wherein said anode extends beyond the anode unit to provide a cathode.

12. The anode unit of claim 11 wherein the cathode is provided with spacing electrically non-conductive buttons thereon.

13. The anode unit of claim 1 provided as a plurality of components bolted together by peripherally disposed bolts.

14. The anode unit of claim 13 wherein the bolts pass through melting apertures in opposed peripheral portions of the framework, the apertures being provided with sealing sleeves or gaskets.

15. The anode unit of claim 1 wherein the anode is titanium, or titanium having a coating thereon of ruthenium oxide, platinum or platinum/iridium.

16. The anode unit of claim 1 wherein the cathode is titanium, low carbon mild steel, or nickel alloys.

17. The anode unit of claim 1 wherein the membrane is a thin unsupported film of plastic material.

18. The anode unit of claim 1 wherein the membrane is Teflon fabric reinforced thin plastic material.

19. The anode unit of claim 17 wherein the plastic is a perfluorinated ion exchange membrane.

20. The anode unit of claim 18 wherein the plastic is a perfluorinated ion exchange membrane.

21. The anode unit of claim 1 wherein the grid-like outer walls comprise a structurally rigid membrane supporting sheet provided with openings or perforations.

22. The anode unit of claim 21 wherein the framework is provided with three inwardly facing channels, within which the plurality of components are disposed, the anode being disposed in the mid-channel, with sealing members disposed between the structurally rigid membrane supporting sheet and outer flanges defining a limit of the outer channels.

23. The anode unit of claim 1 wherein the grid-like outer walls comprise expanded metal sheeting.

24. The anode unit of claim 1 wherein the grid-like outer walls comprise porous sintered powder sheeting.

25. The anode unit of claim 21 wherein the grid-like outer walls are formed of titanium or plastic.

26. The anode unit of claim 21 wherein the grid-like outer walls have 45% open area.

27. The anode unit of claim 1 wherein the grid-like outer walls and membrane are in the form of a single unit comprising porous sintered powdered titanium sheeting of 70% porosity within whose pores are disposed powdered perfluorinated ion exchange material.

28. The anode unit of claim 21 wherein a sealing gasket is provided between the membrane and spacing members disposed adjacent the anode.

29. An electrolyzer cell box comprising:

A. a plurality of rows of banks of interleaved anode units and cathodes, with each bank comprising alternating anode units and cathodes, each said anode unit/cathode comprising a generally rectangular parallelepiped framework including a pair of spaced-apart grid-like structurally rigid peripheral outer side walls; an ionically conductive gas impermeable membrane secured against the inner face of each said outer peripheral walls; an anode disposed between said membranes to provide a pair of anode compartments, said anode extending beyond the anode unit to provide a cathode, the cathode being provided with spacing electrically non-conductive buttons thereon; means for feeding anolyte to said anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from said anode unit; and means associated with the inlet channel for separating and withdrawing entrained and/or occluded gaseous products of electrolysis from the anolyte before the anolyte is fed to the anode compartments;

B. an anode connecting means connected to the last anode of each row of anode units;

C. a cathode connecting means connected to the first cathode of each row of cathodes;

D. anolyte inlet means to the last anode unit of each row of anode units;

E. means for connecting the downstream anode unit to the immediately adjacent upstream anode unit in each row of anode units for cascading anolyte upstream and removing gaseous products of electrolysis;

F. spent anolyte outlet means from the first unit of each row of anode units;

G. catholyte inlet means to the cathode chambers;

H. spent catholyte outlet means; and

I. catholyte gas outlet means.

30. An electrolyzer cell box comprising a generally rectangular parallelepiped box containing:

A. a plurality of rows of banks of interleaved anode units and cathodes, with each bank comprising alternating anode units and cathodes, each said anode unit/cathode comprising a generally rectangular parallelepiped framework including a pair of spaced-apart grid-like structurally rigid peripheral outer side walls; an ionically conductive gas impermeable membrane secured against the inner face of each said outer peripheral walls; an anode disposed between said membranes to provide a pair of anode compartments, said anode extending beyond the anode unit to provide a cathode, the cathode being provided with spacing electrically non-conductive buttons thereon; means for feeding anolyte to said anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from said anode unit; and means associated with the inlet channel for separating and withdrawing entrained and/or occluded gaseous products of electrolysis from the anolyte before the anolyte is fed to the anode compartments;

B. an anode connecting means connected to the last anode of each row of anode units;

C. a cathode connecting means connected to the first cathode of each row of cathodes;

D. anolyte inlet means to the last anode unit of each row of anode units;

E. means for connecting the downstream anode unit to the immediately adjacent upstream anode unit in each row of anode units for cascading anolyte upstream and removing gaseous products of electrolysis;

F. spent anolyte outlet means from the first unit of each row of anode units;

G. catholyte inlet means to the cathode chambers;

H. spent catholyte outlet means;

I. catholyte gas outlet means;

J. a downwardly sloping front wall; and

K. wedge means disposed between an adjacent anode unit of each bank and said front wall, thereby to hold said anode units in place.

31. An electrolyzer cell box comprising a generally rectangular parallelepiped box containing:

A. a plurality of rows of banks of interleaved anode units and cathodes, with each bank comprising alternating anode units and cathode, each said anode unit/cathode comprising a generally rectangular parallelepiped framework including a pair of spaced-apart grid-like str ucturally rigid peripheral outer side walls; an ionically conductive gas impermeable membrane secured against the inner face of each said outer peripheral walls; an anode disposed between said membranes to provide a pair of anode compartments, said anode extending beyond the anode unit to provide a cathode, the cathode being provided with spacing electrically non-conductive buttons thereon; means for feeding anolyte to said anode compartments including a channel member along one edge thereof and a lower trough for feeding and distributing anolyte to the anode compartments; a header for receiving spent anolyte and entrained and/or occluded gaseous products of electrolysis and enabling the withdrawal thereof from the unit and for withdrawing spent anolyte and entrained and/or occluded gaseous products of electrolysis therein from said anode unit; and means associated with the inlet channel for separating and withdrawing entrained and/or occluded gaseous products of electrolysis from the anolyte before the anolyte is fed to the anode compartments;

B. an anode connecting means connected to the last anode of each row of anode units;

C. a cathode connecting means connected to the first cathode of each row of cathodes;

D. anolyte inlet means to the last anode unit of each row of anode units;

E. means for connecting the downstream anode unit to the immediately adjacent upstream anode unit in each row of anode units for cascading anolyte upstream and removing gaseous products of electrolysis;

F. spent anolyte outlet means from the first unit of each row of anode units;

G. catholyte inlet means to the cathode chambers;

H. spent catholyte outlet means;

I. catholyte gas outlet means;

J. a downwardly sloping front wall;

K. wedge means disposed between an adjacent anode unit of each bank and said front wall, thereby to hold said anode units in place;

L. said anolyte inlet means being disposed near the top of said cell box;

M. a plurality of riser pipes extending upwardly from each anode unit, the riser pipes in each bank leading to a common connecting header, each common connecting header leading to an associated common outlet riser which in turn leads to a main anolyte gas outlet header pipe;

N. catholyte inlet means to the top of the sealed cover;

O. spent catholyte outlet overflow weir means from said sealed cover disposed an optimum distance from said catholyte inlet means to provide controlled catholyte level and catholyte gas space; and P. circulation means provided by internal pumping action due to the construction and arrangement of said cathodes and anode units and the rising gaseous products of said electrolysis of said catholyte, with the outlet means from said electrolyzer providing at least a partial separation of entrained gaseous products of electrolysis of the catholyte from the spent catholyte.

32. The electrolyzer of claim 31 wherein the cover slopes upwardly from the catholyte inlet to the catholyte gas outlet.

33. The electrolyzer of claim 32 wherein the catholyte gas outlet leads directly from said cover, from a point adjacent the greater cross-sectional area end thereof.

34. The electrolyzer of claim 31 wherein said cover includes a tray comprising an external extension of said cover, through which said common outlet risers extend.

35. The electrolyzer of claim 31 wherein the wedge extends for substantially the entire height of the cell box.

36. The electrolyzer of claim 31 wherein the wedge cooperates only with the top portion of the cell box.

37. The electrolyzer of claim 31 wherein the liquor outflow means from each anode unit includes a degasifier zone and an outflow riser pipe leading from the degasifier zone to the connecting header.

* * * * *

UNITED STATES PATENT AND TRADEMARK OFFICE

CERTIFICATE OF CORRECTION

PATENT NO. : 4,069,128

DATED : January 17, 1978

INVENTOR(S) : G. OSCAR WESTERLUND

It is certified that error appears in the above–identified patent and that said Letters Patent are hereby corrected as shown below:

Claim 14, line 66: Please change the word "melting" to -- mating --.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*